US009882317B1

(12) United States Patent
Lane

(10) Patent No.: US 9,882,317 B1
(45) Date of Patent: Jan. 30, 2018

(54) CONNECTOR SYSTEM WITH HYBRID ELECTRICAL CONNECTORS

(71) Applicant: TYCO ELECTRONICS CORPORATION, Berwyn, PA (US)

(72) Inventor: David James Lane, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/266,252

(22) Filed: Sep. 15, 2016

(51) Int. Cl.
*H01R 13/514* (2006.01)
*H01R 13/6588* (2011.01)
*H01R 24/20* (2011.01)
*H01R 13/426* (2006.01)

(52) U.S. Cl.
CPC ..... *H01R 13/6588* (2013.01); *H01R 13/426* (2013.01); *H01R 24/20* (2013.01)

(58) Field of Classification Search
CPC ..... H01R 13/4362; H01R 13/4223; H01R 13/4226
USPC ..... 439/752, 595, 577, 626, 653, 581
See application file for complete search history.

(56) References Cited

U.S. PATENT DOCUMENTS 6,183,299 B1 * 2/2001 Ward ..... H01R 13/4223 439/595
7,029,286 B2 * 4/2006 Hall ..... H01R 13/506 439/357
7,540,772 B2 * 6/2009 Sardi ..... B60L 11/1818 439/581
7,661,987 B2 * 2/2010 Adachi ..... H01R 9/0518 439/595
7,682,205 B2 * 3/2010 Hall ..... H01R 13/4361 439/752
7,824,218 B2 * 11/2010 Gleissner ..... H01R 13/42 439/595
7,867,042 B2 1/2011 Shuey
8,011,977 B2 * 9/2011 Tsuruta ..... H01R 13/4365 439/752
9,004,946 B2 * 4/2015 Hoeppner ..... H01R 13/53 439/607.41
2008/0026639 A1 * 1/2008 Sardi ..... B60L 11/1818 439/607.41
2012/0149240 A1 * 6/2012 Ishibashi ..... H01R 13/4223 439/595

* cited by examiner

*Primary Examiner* — Hae Moon Hyeon

(57) ABSTRACT

A hybrid electrical connector is provided that includes a housing having a unitary, one-piece body that extends between a front end and an opposite rear end. The housing defines two adjacent cavities each extending between a respective mating opening at the front end and a respective cable opening at the rear end. The two cavities include a shielded cavity configured to hold a shielded contact subassembly therein and an unshielded cavity configured to hold an unshielded contact subassembly therein. The housing includes a first deflectable latch extending into the shielded cavity and directly engaging the shielded contact subassembly therein to secure the shielded contact subassembly within the housing. The housing further includes a second deflectable latch extending into the unshielded cavity and directly engaging the unshielded contact subassembly therein to secure the unshielded contact subassembly within the housing.

20 Claims, 8 Drawing Sheets

CONNECTOR SYSTEM WITH HYBRID ELECTRICAL CONNECTORS

BACKGROUND OF THE INVENTION

The subject matter herein relates generally to electrical connector systems.

Connector systems having radio frequency (RF) electrical connectors have been used for numerous applications including military applications and automotive applications, such as global positioning systems (GPS), antennas, radios, mobile phones, multimedia devices, and the like. The connectors may be coaxial cable connectors that are provided at the ends of coaxial cables.

Some electrical connectors include housings that hold at least two different types of electrical contact subassemblies therein, and each electrical contact subassembly is electrically connected to a different type of cable. Such electrical connectors are referred to herein as "hybrid" electrical connectors, since different types of contact subassemblies are held in the same housing. For example, one type of contact subassembly may be a shielded contact subassembly, such as a coaxial contact subassembly, and another type may be an unshielded contact subassembly in which a terminal is not surrounded by a shielding component.

Known hybrid electrical connectors are not without disadvantages. Some hybrid electrical connectors are complex and include many different components that must be assembled together, which increases manufacturing and assembly costs. For example, in addition to the housing and the two or more contact subassemblies held within the housing, some hybrid electrical connectors include separate inserts (e.g., to engage and hold an unshielded contact subassembly in position). The separate insert may move (e.g., become bent or dislodged) relative to the housing, which may cause, for example, stubbing as a mating connector is mated to the electrical connector. The contact subassemblies may be held in the housing by respective latching mechanisms. In known hybrid electrical connectors, the latching mechanisms are not all properly supported by a locking component that prevents the contact subassemblies from undesirably being pulled out of the housing. A need remains for a connector system having hybrid electrical connectors that reduce stubbing, provide support for the latching mechanisms, reduce the total number of components, and simplify assembly relative to known hybrid electrical connectors.

BRIEF DESCRIPTION OF THE INVENTION

In one embodiment, a hybrid electrical connector is provided that includes a housing having a unitary, one-piece body that extends between a front end and an opposite rear end. The housing defines two adjacent cavities each extending between a respective mating opening at the front end and a respective cable opening at the rear end. The two cavities include a shielded cavity configured to hold a shielded contact subassembly therein and an unshielded cavity configured to hold an unshielded contact subassembly therein. The housing includes a first deflectable latch extending into the shielded cavity and directly engaging the shielded contact subassembly therein to secure the shielded contact subassembly within the housing. The housing further includes a second deflectable latch extending into the unshielded cavity and directly engaging the unshielded contact subassembly therein to secure the unshielded contact subassembly within the housing.

In another embodiment, a hybrid electrical connector is provided that includes a housing and a terminal position assurance (TPA) clip. The housing having a unitary, one-piece body that extends between a front end and an opposite rear end, the housing defining two adjacent cavities each extending between a respective mating opening at the front end and a respective cable opening at the rear end, the two cavities including a shielded cavity configured to hold a shielded contact subassembly therein and an unshielded cavity configured to hold an unshielded contact subassembly therein, the housing including a first deflectable latch extending into the shielded cavity and directly engaging the shielded contact subassembly therein to retain the shielded contact subassembly within the housing, the housing further including a second deflectable latch extending into the unshielded cavity and directly engaging the unshielded contact subassembly therein to secure the unshielded contact subassembly within the housing. The TPA clip is coupled to the housing, the TPA clip extending through a recess through a side wall of the housing, the recess located generally between the shielded and unshielded cavities.

In another embodiment, a connector system is provided that includes a first hybrid electrical connector and a second hybrid electrical connector configured to mate to one another. The first hybrid electrical connector has a plug housing extending between a front end and an opposite rear end. The plug housing defines two adjacent cavities that each extend between a respective mating opening at the front end and a respective cable opening at the rear end. The two cavities include a shielded cavity configured to hold a shielded contact subassembly therein and an unshielded cavity configured to hold an unshielded contact subassembly therein. The plug housing includes a core structure and two adjacent cylindrical shrouds extending from a front wall of the core structure to the front end. The cylindrical shrouds define the mating openings of the shielded and unshielded cavities. The plug housing includes a first deflectable latch extending into the shielded cavity and directly engaging the shielded contact subassembly therein to secure the shielded contact subassembly within the plug housing. The plug housing further includes a second deflectable latch extending into the unshielded cavity and directly engaging the unshielded contact subassembly therein to secure the unshielded contact subassembly within the plug housing. The second hybrid electrical connector has a receptacle housing extending between a front end and an opposite rear end. The receptacle housing defines two adjacent cavities that each extend between a respective mating opening at the front end and a respective cable opening at the rear end. The two cavities include a shielded cavity configured to hold a shielded contact subassembly therein and an unshielded cavity configured to hold an unshielded contact subassembly therein. The receptacle housing includes a first deflectable latch extending into the shielded cavity and directly engaging the shielded contact subassembly therein to secure the shielded contact subassembly within the receptacle housing. The receptacle housing further includes a second deflectable latch extending into the unshielded cavity and directly engaging the unshielded contact subassembly therein to secure the unshielded contact subassembly within the receptacle housing. The receptacle housing is configured to receive the cylindrical shrouds of the plug housing into the corresponding shielded and unshielded cavities of the receptacle housing through the respective mating openings as the first and second hybrid electrical connectors are mated such that the shielded contact subassembly in the receptacle housing electrically connects to the shielded contact subassembly in the plug housing and the unshielded contact subassembly in the receptacle housing electrically connects to the unshielded contact subassembly in the plug housing.

DETAILED DESCRIPTION OF THE INVENTION

Figure 1:
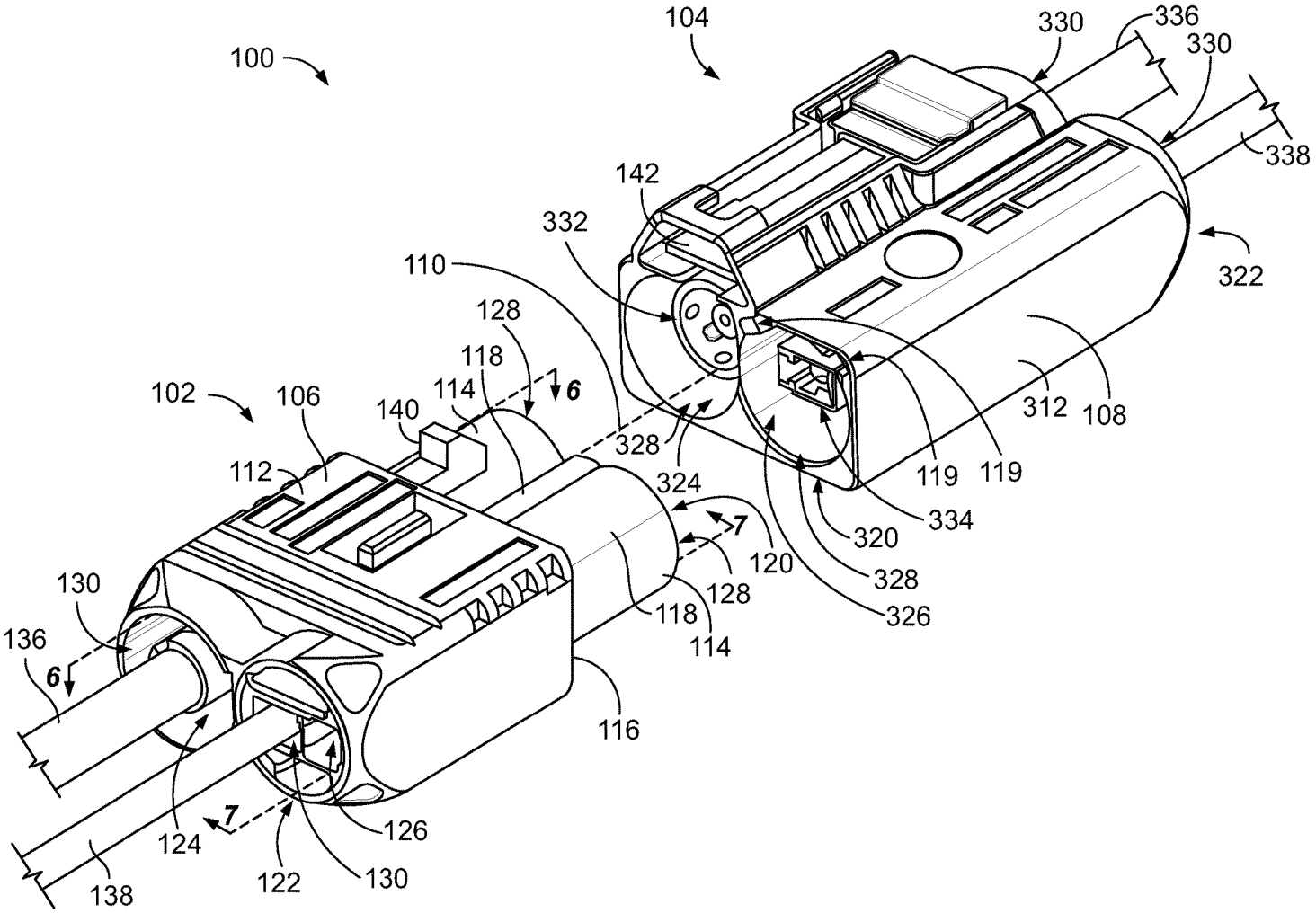
FIG. 1 illustrates a connector system formed in accordance with an exemplary embodiment.

FIG. 1 illustrates a connector system 100 formed in accordance with an exemplary embodiment. The connector system 100 includes a first hybrid electrical connector 102 and a second hybrid electrical connector 104 that are configured to be mated together to transmit electrical current, such as signals, therebetween. The first and second electrical connectors 102, 104 are referred to as hybrid connectors because each has a respective housing that holds two different kinds of contact subassemblies therein. For example, both connectors 102, 104 include both an unshielded and a shielded cable-mounted contact subassembly. The housings of the electrical connectors 102, 104 may each include deflectable latches integrally connected to the housing that engage the contact subassemblies directly to secure the contact subassemblies in the respective housings without the use of a separate insert. The housings of the electrical connectors 102, 104 may include guide walls that are integrally connected to the housing to reduce the occurrence of stubbing during the mating operation. The first and second hybrid electrical connectors 102, 104 may each include a respective terminal position assurance (TPA) clip that couples to the respective housing. Each TPA clip may be configured to back-up both of the deflectable latches of the corresponding housing to which the TPA clip is coupled in order to support the deflectable latches and further secure the contact subassemblies in the housings.

The connector system 100 may be used in numerous applications across various industries, such as the automotive industry, the home appliance industry, the aviation industry, and the like, to electrically couple two or more devices and/or electrical components. For example, in the automotive industry, the hybrid electrical connectors 102, 104 may be used for radio frequency communications, such as to electrically connect an antenna to a processing device of an infotainment system.

In the illustrated embodiment, the first hybrid electrical connector 102 and the second hybrid electrical connector 104 constitute FAKRA connectors which are RF connectors that have an interface that complies with the standard for a uniform connector system established by the FAKRA automobile expert group. FAKRA is the Automotive Standards Committee in the German Institute for Standardization, representing international standardization interests in the automotive field. The FAKRA connectors have a standardized keying system and locking system that fulfill the high functional and safety requirements of automotive applications. For example, the first hybrid electrical connector 102 in the illustrated embodiment has one or more keying ribs 118, and the second hybrid electrical connector 104 has one or more keying channels 119 that receive the keying ribs 118 when the connectors 102, 104 are mated. The keying ribs 118 and the keying channels 119 are configured to limit the mate-ability of each of the connectors 102, 104 to one or more specific mating connectors according to the FAKRA standards. In an alternative embodiment, the connectors 102, 104 of the connector system 100 may comply with a connector standard other than the FAKRA standard.

The first and second hybrid electrical connectors 102, 104 include respective housings 106, 108. In the illustrated embodiment, the housing 106 of the first connector 102 is a plug housing 106, and the housing 108 of the second connector 104 is a receptacle housing 108 such that a portion of the plug housing 106 is received within the receptacle housing 108 as the first and second connectors 102, 104 are mated along a mating axis 110. As used herein, the first hybrid connector 102 may be referred to as a plug hybrid connector 102, and the second hybrid connector 104 may be referred to as a receptacle hybrid connector 104.

The plug housing 106 includes a core structure 112 and two cylindrical shrouds 114 extending from a front wall 116 of the core structure 112. The plug housing 106 extends between a front end 120 and a rear end 122. The cylindrical shrouds 114 define the front end 120, and the core structure 112 is rearward of the shrouds 114. As used herein, relative or spatial terms such as "front," "rear," "top," or "bottom" are only used to distinguish the referenced elements and do not necessarily require particular positions or orientations relative to the surrounding environment of the connector system 100.

In an embodiment, the plug hybrid electrical connector 102 is a dual connector, as the plug housing 106 defines two cavities 124, 126. The two cavities 124, 126 include a shielded cavity 124 and an unshielded cavity 126 that are configured to receive and hold a different type of contact subassembly. Both cavities 124, 126 extend between a respective mating opening 128 at the front end 120 and a respective cable opening 130 at the rear end 122. The cylindrical shrouds 114 align with and define portions of the two cavities 124, 126, including the mating openings 128. The shielded cavity 124 holds a shielded contact subassembly 132 (shown in FIG. 2) therein, and the unshielded cavity 126 holds an unshielded contact subassembly 134 (FIG. 2) therein. The shielded contact subassembly 132 is electrically connected and mounted to a first electrical cable 136, which extends from the cable opening 130 of the shielded cavity 124. The unshielded contact subassembly 134 is electrically connected and mounted to a second electrical cable 138, which extends from the cable opening 130 of the unshielded cavity 126.

The receptacle housing 108 extends between a front end 320 and a rear end 322. The receptacle housing 108 has a core structure 312 that extends approximately the entire length of the housing 108 between the front and rear ends 320, 322. The housing 108 defines both a shielded cavity 324 and an unshielded cavity 326 that are adjacent to one another and extend between respective mating openings 328 at the front end 320 and respective cable openings 330 at the rear end 322. The receptacle housing 108 holds a shielded contact subassembly 332 in the shielded cavity 324 and holds an unshielded contact subassembly 334 in the unshielded cavity 326. The shielded contact subassembly 332 is electrically connected and mounted to a third electrical cable 336, which extends from the cable opening 330 of the shielded cavity 324. The unshielded contact subassembly 334 is electrically connected and mounted to a fourth electrical cable 338, which extends from the cable opening 330 of the unshielded cavity 326.

In an embodiment, the plug hybrid electrical connector 102 is mated to the receptacle hybrid electrical connector 104 by moving the connectors 102, 104 relative to one another along the mating axis 110. The cylindrical shrouds 114 of the plug housing 106 are received in the corresponding mating openings 328 of the cavities 324, 326 of the receptacle housing 108. The keying ribs 118 are received in the complementary keying channels 119. In the illustrated embodiment, the plug housing 106 includes a primary catch 140 located on one of the cylindrical shrouds 114. The receptacle housing 108 includes a deflectable primary latch 142 that is configured to latch onto the primary catch 140 when the plug and receptacle hybrid electrical connectors 102, 104 are fully mated to one another to retain the connectors 102, 104 in the mated position. The primary latch 142 is configured to be lifted or pivoted over the catch 140 in order to disconnect the two connectors 102, 104. In the mated position, the shielded contact subassembly 132 in the plug housing 106 electrically connects to the shielded contact subassembly 332 in the receptacle housing 108, and the unshielded contact subassembly 134 electrically connects to the unshielded contact subassembly 334.

Figure 2:
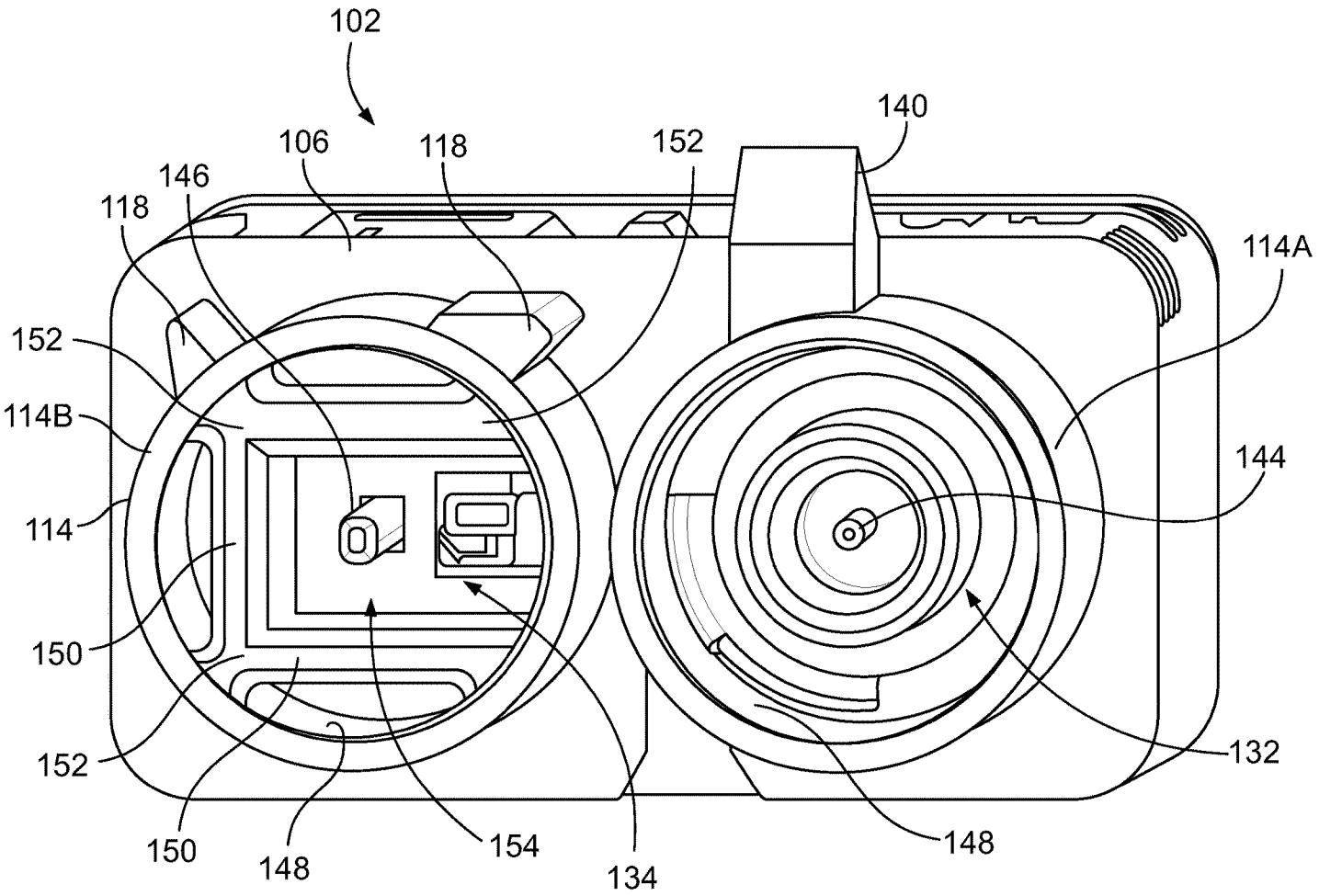
FIG. 2 is a front view of a plug hybrid connector of the connector system according to an embodiment.

FIG. 2 is a front view of the plug hybrid connector 102 according to an embodiment. A mating segment of the shielded contact subassembly 132 is visible in the portion of the shielded cavity 124 defined by a first cylindrical shroud 114A of the two cylindrical shrouds 114. A mating segment of the unshielded contact subassembly 134 is visible in the portion of the unshielded cavity 126 defined by a second cylindrical shroud 114B of the two shrouds 114. The mating segment of the shielded contact subassembly 132 includes a center contact 144 in the shape of a pin. Similarly, the mating segment of the unshielded contact subassembly 134 includes a pin-shaped terminal 146. In the illustrated embodiment, the first cylindrical shroud 114A includes the primary catch 140, and the second cylindrical shroud 114B includes the keying ribs 118, but in other embodiments the catch 140 and the keying ribs 118 may be arranged differently between the two shrouds 114A, 114B.

In the illustrated embodiment, the cylindrical shrouds 114 have approximately the same size (for example, inner diameter and/or outer diameter). The shrouds 114 have generally cylindrical shapes defined by curved interior walls 148. In an embodiment, the second shroud 114B (that defines a portion of the unshielded cavity 126) includes planar guide walls 150 therein. The planar guide walls 150 define a channel 154 within the shroud 114B that is configured to receive a terminal 346 of the unshielded contact subassembly 334 therein as the hybrid electrical connectors 102, 104 are mated. The planar guide walls 150 are integrally connected to the curved interior walls 148 of the shroud 114B. For example, the edges 152 of the planar guide walls 150 are secured to the curved interior walls 148. In an embodiment, the planar guide walls 150 are formed integrally with the shroud 114B, such as during a common molding process. In an alternative embodiment, the planar guide walls 150 are integrally connected to the shroud 114B via a bonding process after the shroud 114B is formed. Since the edges 152 of the guide walls 150 are connected to the interior walls 148 of the shroud 114B, the guide walls 150 do not bow or bend out of position, so there is little or no risk of stubbing on the unshielded contact subassembly 334 during the mating operation. In the illustrated embodiment, the shroud 114B includes three guide walls 150 therein such that the channel 154 has three planar sides defined by the three guide walls 150 and one curved side defined by the interior wall 148 of the shroud 114B.

Figure 3:
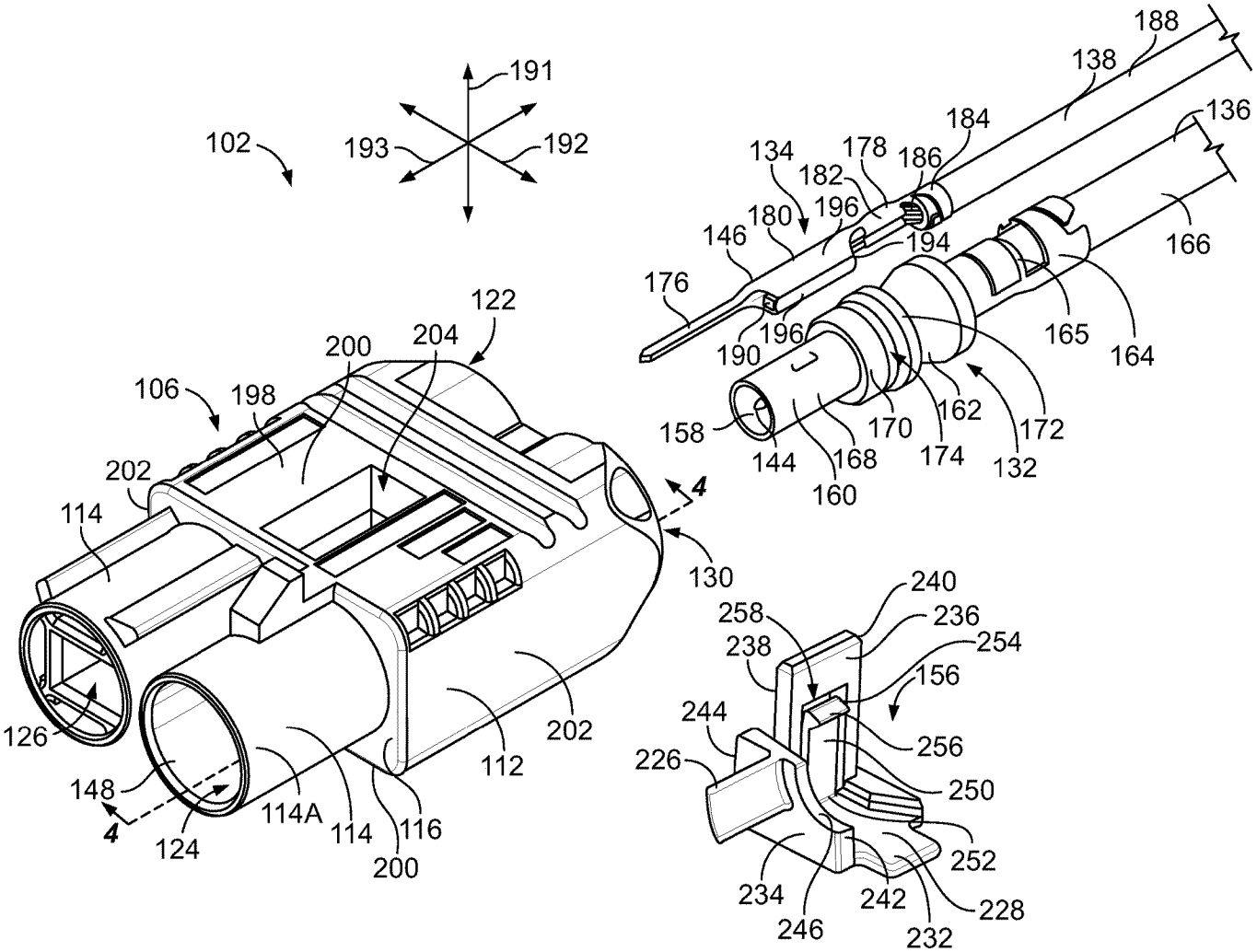
FIG. 3 is an exploded perspective view of the plug hybrid electrical connector according to an embodiment.

FIG. 3 is an exploded perspective view of the plug hybrid electrical connector 102 according to an embodiment. The plug hybrid connector 102 includes the plug housing 106, the shielded contact subassembly 132, the unshielded contact subassembly 134, and a terminal position assurance (TPA) clip 156. The TPA clip 156 supports the retention of both contact subassemblies 132, 134 in the plug housing 106. Optionally, the TPA clip 156 is also configured to block mating of the hybrid connectors 102, 104 if the TPA clip 156 is not fully inserted into the plug housing 106 such that the TPA clip 156 is in a partially inserted position. The exploded connector 102 is oriented with respect to a vertical or elevation axis 191, a lateral axis 192, and a longitudinal axis 193. The axes 191-193 are mutually perpendicular. Although the vertical axis 191 appears to extend generally parallel to gravity, it is understood that the axes 191-193 are not required to have any particular orientation with respect to gravity. The shielded contact subassembly 132 is poised for loading along the longitudinal axis 193 into the shielded cavity 124 of the plug housing 106 through the cable opening 130. The unshielded contact subassembly 134 is poised for loading along the longitudinal axis 193 into the unshielded cavity 126 of the plug housing 106.

In the illustrated embodiment, the shielded contact subassembly 132 includes the center contact 144, a dielectric body 158 surrounding the center contact 144, an outer contact 160 surrounding the dielectric body 158, and a cavity insert 162 surrounding the outer contact 160. The center contact 144 and the outer contact 160 are conductive components 144, 160 that are each composed of one or more metals. The shielded contact subassembly 132 is referred to as "shielded" because the outer contact 160 is a conductive component that surrounds and shields the center contact 144 from electromagnetic or radio frequency interference. In the illustrated embodiment, the center contact 144 constitutes a pin contact, but the center contact 144 may be a socket contact or another type of contact in another embodiment. The center contact 144 is terminated to the center conductor (not shown) of the cable 136, such as via crimping or soldering. The dielectric body 158 is composed of a dielectric material, such as one or more plastics, and is configured to electrically insulate the center contact 144 from the outer contact 160. The outer contact 160 has a generally cylindrical or barrel shape that may be formed via stamping and forming or a casting process.

The cavity insert 162 surrounds at least a portion of the outer contact 160. For example, in the illustrated embodiment, the cavity insert 162 surrounds and engages a middle segment of the outer contact 160. A mating segment 168 of the outer contact 160 extends forward of the cavity insert 162. The cavity insert 162 is an adapter that is configured to engage one or more walls of the plug housing 106 inside the shielded cavity 124 to hold the shielded contact subassembly 132 in a fixed axial position within the shielded cavity 124. For example, the cavity insert 162 includes at least one flange that extends circumferentially along a perimeter of the cavity insert 162. The cavity insert 162 in the illustrated embodiment includes at least first and second flanges 170, 172 that define a cylindrical groove 174 therebetween. The flanges 170, 172 are configured to engage interior walls of the plug housing 106 and/or the TPA clip 156 to retain the axial position of the shielded contact subassembly 132 in the shielded cavity 124.

The shielded contact subassembly 132 is electrically terminated (e.g., crimped, soldered, etc.) to the first electrical cable 136 via a ferrule 164. The first electrical cable 136 may be a coaxial cable that has a center conductor (not shown) and a conductive shield layer 165 that are separated from one another by a dielectric layer (not shown). The conductive shield layer 165 may be or include a cable braid that includes metal strands woven or braided into a layer. A cable jacket 166 surrounds the conductive shield layer 165 and provides protection for the conductive components of the cable 136 against external forces and contaminants. The ferrule 164 is crimped over the cable 136 to mechanically secure and electrically connect the cable 136 to the shielded contact subassembly 132. For example, the ferrule 164 may be crimped to the shield layer 165 of the cable 136 to electrically terminate the shield layer 165 to the outer contact 160, and the ferrule 164 may also be crimped to the cable jacket 166 to provide strain relief.

The unshielded contact subassembly 134 includes the terminal 146 which is electrically terminated to the second electrical cable 138. The terminal 146 is electrically conductive and composed of one or more metals. The terminal 146 may be stamped and formed, cast, or otherwise molded into the illustrated shape. Unlike the center contact 144 of the shielded contact subassembly 132, the terminal 146 is not surrounded by another conductive component. The terminal 146 in the illustrated embodiment includes a mating segment 176, a terminating segment 178, and a base segment 180 between the mating and terminating segments 176, 178. The mating segment 176 is pin-shaped and configured to engage a complementary socket contact of the unshielded contact subassembly 334 (shown in FIG. 1) of the receptacle connector 104 (FIG. 1), but the mating segment 176 may have other shapes in alternative embodiments. The terminating segment 178 mounts the terminal 146 to the cable 138. The terminating segment 178 may include both a conductor crimp barrel 182 that directly engages center conductors 186 (for example, one or more wire) of the cable 138 and an insulation crimp barrel 184 that directly engages an insulation jacket 188 of the cable 138. In the illustrated embodiment, the second cable 138 is not a coaxial cable, unlike the first cable 136. The base segment 180 of the terminal 146 may be generally box-shaped having multiple walls. For example, the base segment 180 includes a front wall 190 that faces the mating segment 176, a rear wall 194 that faces the terminating segment 178, and multiple side walls 196 that each extend between the front and rear walls 190, 194. The base segment 180 is used for positioning and orienting the unshielded contact subassembly 134 in the unshielded cavity 126. The base segment 180 may also engage the plug housing 106 and/or the TPA clip 156 to retain the axial position of the unshielded contact subassembly 134 in the plug housing 106.

The plug housing 106 in an embodiment has a unitary, one-piece body 198 such that the cylindrical shrouds 114 are integrally connected to the core structure 112. The plug housing 106 may be composed of a dielectric material, such as one or more plastics. The two shrouds 114 are located adjacent to one another along the lateral axis 192. The core structure 112 includes two side walls 200 and two end walls 202 that each extend between the front wall 116 and the rear end 122 of the housing 106. Each side wall 200 extends along the lateral axis 192 and has a lateral width equal to or greater than the combined lateral width of the shrouds 114. Each end wall 202 has a height along the vertical axis 191 that is equal to or greater than the shrouds 114 individually. The plug housing 106 defines a recess 204 that extends through at least one of the side walls 200. The recess 204 is located generally between the shielded and unshielded cavities 124, 126. The recess 204 is configured to receive the TPA clip 156 therein to mount the TPA clip 156 to the plug housing 106.

Figure 4:
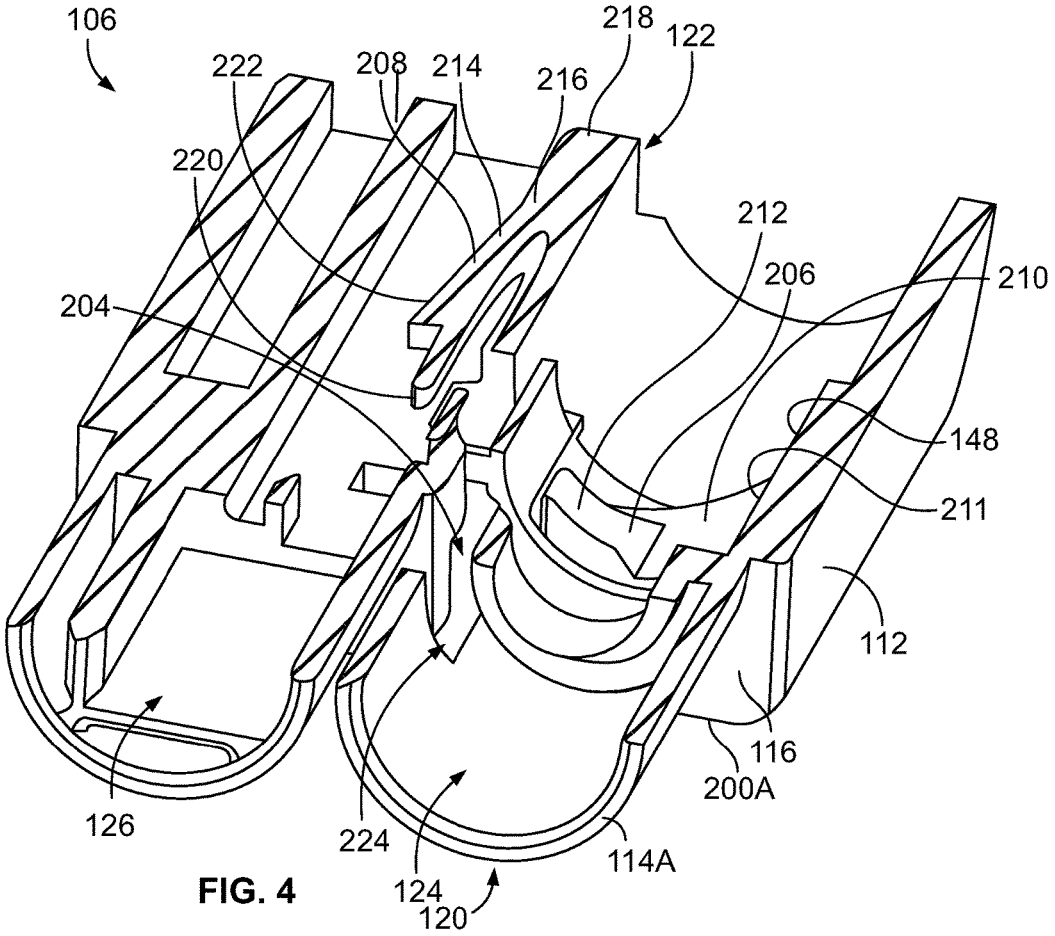
FIG. 4 is a front cross-sectional perspective view of a plug housing of the plug hybrid electrical connector taken along line 4-4 shown in FIG. 3.

Referring now to FIG. 4, FIG. 4 is a front cross-sectional perspective view of the plug housing 106 taken along line 4-4 shown in FIG. 3. Both the shielded and unshielded cavities 124, 126 extend the full length of the plug housing 106 between the front and rear ends 120, 122. The plug housing 106 in an embodiment includes a first deflectable latch 206 that extends into the shielded cavity 124 and is configured to directly engage the shielded contact subassembly 132 (shown in FIG. 3). The plug housing 106 further includes a second deflectable latch 208 that extends into the unshielded cavity 126 and is configured to directly engage the unshielded contact subassembly 134 (shown in FIG. 3). Both the first and second deflectable latches 206, 208 are integrally connected to the housing 106. For example, the latches 206, 208 may be formed integrally with the housing 106 during a common molding process.

The first deflectable latch 206 extends generally along a bottom region of the shielded cavity 124 proximate to a bottom side wall 200A of the plug housing 106. The deflectable latch 206 has a curved arm 210 that extends from a fixed end 211 that is secured to the curved interior wall 148 to a head 212. The head 212 is a protrusion that extends radially inwards into the shielded cavity 124. As the shielded contact subassembly 132 (shown in FIG. 3) is loaded into the plug housing 106, the shielded contact subassembly 132 may engage the head 212 of the deflectable latch 206, deflecting the latch 206 radially outward away from the cavity 124 about the fixed end 211 of the latch 206. For example, the latch 206 may deflect generally downward. The deflection of the latch 206 allows the shielded contact subassembly 132 to be fully loaded within the shielded cavity 124.

The second deflectable latch 208 extends generally along a lateral side region of the unshielded cavity 126. The deflectable latch 208 includes an arm 214 that is cantilevered to extend from a fixed end 216 at a divider wall 218 between the shielded and unshielded cavities 124, 126 to a distal free end 220. The fixed end 216 is secured to the divider wall 218. The deflectable latch 208 has a ramp surface 222 that extends into the unshielded cavity 126. As the unshielded contact subassembly 134 (shown in FIG. 3) is loaded into the plug housing 106, the unshielded contact subassembly 134 may engage the ramp surface 222, deflecting the latch 208 laterally outward toward the divider wall 218 (and away from the cavity 126) about the fixed end 216 of the latch 208. The deflection of the latch 208 allows the unshielded contact subassembly 134 to be fully loaded within the unshielded cavity 126.

As shown in FIG. 4, the recess 204 of the plug housing 106 extends through the bottom side wall 200A. The recess 204 is located frontward of the divider wall 218 extending between the two cavities 124, 126. In an embodiment, the cylindrical shroud 114A that defines a portion of the shielded cavity 124 includes a cutout segment 224 located longitudinally proximate to the front wall 116 of the core structure 112 from which the shroud 114A extends. The cutout segment 224 is open to the recess 204. In an embodiment, the cutout segment 224 is configured to receive a position assurance tab 226 (shown in FIG. 3) of the TPA clip 156 therein, such that the position assurance tab 226 defines a segment of the shroud 114A when the TPA clip 156 is fully inserted relative to the housing 106.

Figure 5:
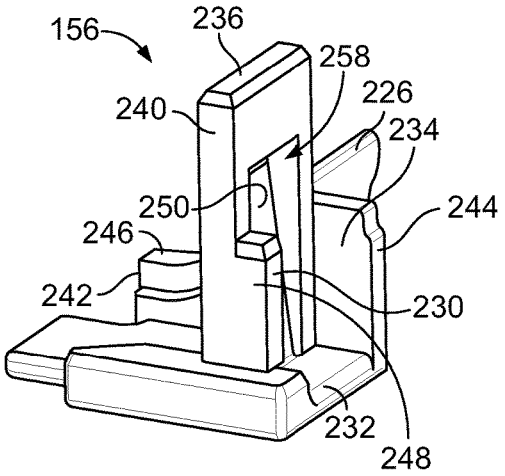
FIG. 5 is a rear perspective view of a TPA clip of the plug hybrid electrical connector shown in FIG. 3.

Referring now to FIGS. 3-5, FIG. 5 is a rear perspective view of the TPA clip 156 shown in FIG. 3. The TPA clip 156 is configured to be inserted through the recess 204 of the plug housing 106 to couple the TPA clip 156 to the plug housing 106. In an embodiment, the TPA clip 156 is configured to support the retention of the shielded and unshielded contact subassemblies 132, 134 in the plug housing 106 by backing up the first and second deflectable latches 206, 208. For example, the TPA clip 156 defines a first blocking surface 228 and a second blocking surface 230. The first blocking surface 228 is configured to block the first deflectable latch 206 from deflecting away from the shielded contact subassembly 132 held in the shielded cavity 124. The second blocking surface 230 is configured to block the second deflectable latch 208 from deflecting away from the unshielded contact subassembly 134 held in the unshielded cavity 126. The TPA clip 156 may be composed of a dielectric material, such as one or more plastics. The TPA clip 156 may be formed via a molding process.

The TPA clip 156 includes a planar bottom wall 232 and a front wall 234 extending generally vertically from the bottom wall 232. The position assurance tab 226 extends forward from the front wall 234. The position assurance tab 226 has a curved profile that generally matches the curved interior walls 148 of the cylindrical shroud 114A. The front wall 234 extends between a first perimeter side 242 and a second perimeter side 244. The front wall 234 defines a concave curved segment 246 along the first perimeter side 242.

The TPA clip 156 may also include an upright wall 236 extending generally vertically from the bottom wall 232. The upright wall 236 extends between a front end 238 at the front wall 234 and a rear end 240. The upright wall 236 includes a ledge 248 at least proximate to the rear end 240 that projects laterally from the upright wall 236. The TPA clip 156 further includes a deflectable coupling latch 250 that extends generally vertically from a fixed end 252 secured to the bottom wall 232 to a distal, free end 254 that includes a hook feature 256. The coupling latch 250 is used to couple the TPA clip 156 to the plug housing 106. Optionally, the coupling latch 250 may be located within a window 258 defined in the upright wall 236, with the hook feature 256 protruding out of the plane of the upright wall 236.

In an embodiment, the bottom wall 232 defines the first blocking surface 228 that backs up the first deflectable latch 206 in the shielded cavity 124, and the ledge 248 of the upright wall 236 defines the second blocking surface 230 that backs up the second deflectable latch 208 in the unshielded cavity 126. For example, when the TPA clip 156 is inserted into the housing 106, the bottom wall 232 blocks deflection of the first deflectable latch 206 and the ledge 248 blocks deflection of the second deflectable latch 208. Furthermore, the concave curved segment 246 of the front wall 234 extends into the shielded cavity 124 and is received in the groove 174 of the cavity insert 162. The concave curved segment 246 may engage the first and/or second flanges 170, 172 to retain the axial position of the shielded contact subassembly 132 in the shielded cavity 124. Optionally, the second perimeter side 244 of the front wall 234 may extend into the unshielded cavity 126 to engage the base segment 180 of the terminal 146, which may support maintaining a designated orientation of the unshielded contact subassembly 134 in the unshielded cavity 126.

Figure 6:
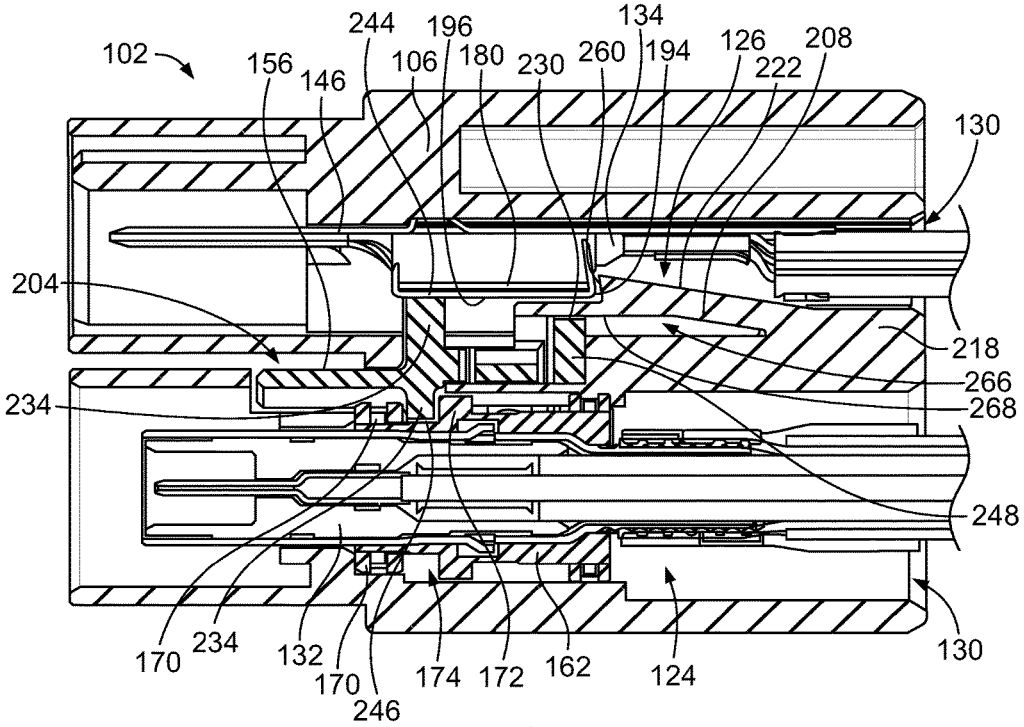
FIG. 6 is a top-down cross-sectional view of the plug hybrid electrical connector taken along line 6-6 shown in FIG. 1 according to an embodiment.
Figure 7:
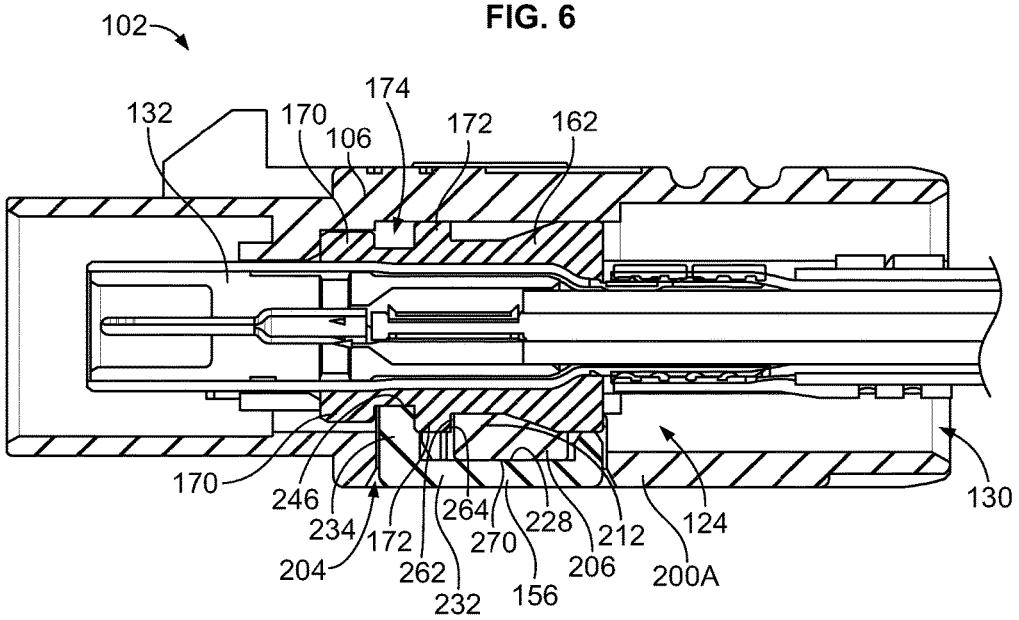
FIG. 7 is a side cross-sectional view of the plug hybrid electrical connector taken along line 7-7 shown in FIG. 1.

FIG. 6 is a top-down cross-sectional view of the plug hybrid electrical connector 102 taken along line 6-6 shown in FIG. 1 according to an embodiment. FIG. 7 is a side cross-sectional view of the plug hybrid electrical connector 102 taken along line 7-7 shown in FIG. 1. FIGS. 6 and 7 show different views of the plug hybrid electrical connector 102 in an assembled state, with both the shielded and unshielded contact subassemblies 132, 134 loaded in the corresponding shielded and unshielded cavities 124, 126 of the plug housing 106, and the TPA clip 156 fully inserted into the recess 204 of the plug housing 106.

Referring to FIG. 6, as the unshielded contact subassembly 134 is loaded into the unshielded cavity 126 through the cable opening 130, the base segment 180 of the terminal 146 engages the ramp surface 222 of the second deflectable latch 208, which causes the latch 208 to deflect towards the divider wall 218. The second deflectable latch 208 includes a catch surface 260 extending from a distal end of the ramp surface 222. When the rear wall 194 extends beyond the catch surface 260, the deflectable latch 208 is permitted to resiliently return towards an unbiased position in the unshielded cavity 126. The catch surface 260 is configured to engage the rear wall 194 of the base segment 180 or another rear-facing wall of the terminal 146 to secure the unshielded contact subassembly 134 in the housing 106.

Referring now to FIG. 7, as the shielded contact subassembly 132 is loaded into the shielded cavity 124 through the cable opening 130, the cavity insert 162 engages the head 212 of the first deflectable latch 206, which causes the latch 206 to deflect downwards away from the shielded cavity 124. The first deflectable latch 206 includes a catch surface 262 at a front end of the head 212. When the second flange 172 extends beyond the catch surface 262, the deflectable latch 206 is permitted to resiliently return towards an unbiased position in the shielded cavity 124. The catch surface 262 is configured to engage a rear shoulder 264 of the second flange 172 (or another rear shoulder) to secure the shielded contact subassembly 132 in the housing 106.

Referring back to FIG. 6, once the shielded and unshielded contact subassemblies 132, 134 are fully loaded in the plug housing 106, the TPA clip 156 is configured to be inserted into the recess 204 between the two cavities 124, 126. In the fully inserted position of the TPA clip 156, the ledge 248 extends at least partially into the unshielded cavity 126. The ledge 248 extends into a gap 266 between an exterior surface 268 of the deflectable latch 208 and the divider wall 218. The blocking surface 230 of the ledge 248 engages the exterior surface 268 to block the latch 208 from deflecting into the gap 266 away from the unshielded contact subassembly 134. Therefore, the latch 208 is restricted from disengaging the rear wall 194 of the terminal 146. The second perimeter side 244 of the front wall 234 of the TPA clip 156 optionally extends into the unshielded cavity 126 and engages a side wall 196 of the base segment 180 to maintain a designated orientation of the unshielded contact subassembly 134 in the cavity 126. The concave curved segment 246 of the front wall 234 is received within the cylindrical groove 174 defined between the first and second flanges 170, 172 of the cavity insert 162.

Returning to FIG. 7, when the TPA clip 156 is fully inserted in the housing 106, the bottom wall 232 aligns generally with the bottom side wall 200A of the housing 106. The blocking surface 228 of the bottom wall 232 engages an exterior surface 270 of the first deflectable latch 206 to block the first deflectable latch 206 from deflecting away from the shielded contact subassembly 132. Thus, the latch 206 is restricted from disengaging the rear shoulder 264 of the flange 172. FIG. 7 also shows a portion of the concave curved segment 246 of the front wall 234 disposed in the groove 174 between the first and second flanges 170, 172 of the cavity insert 162.

As shown in FIGS. 6 and 7, the TPA clip 156 is configured to back up the deflectable latches 206, 208 in the shielded and unshielded cavities 124, 126 to block deflection of the latches 206, 208. The TPA clip 156 may also be configured to engage the shielded and unshielded contact subassemblies 132, 134 directly to support maintaining the contact subassemblies 132, 134 in corresponding designated axial positions and angular orientations.

In an embodiment, the plug housing 106 may be constructed such that the shielded cavity 124 and/or the unshielded cavity 126 are able to accommodate corresponding contact subassemblies of different types and/or sizes. In addition, the cable openings 130 may be sized to accommodate large cables.

Figure 8:
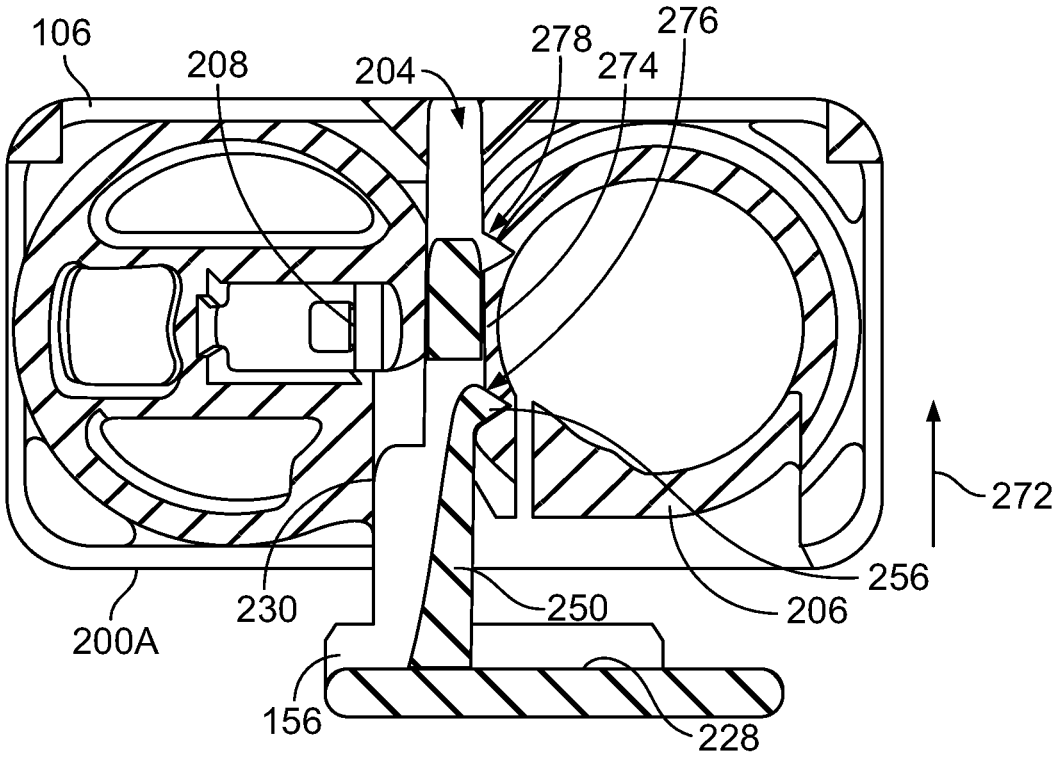
FIG. 8 shows a front cross-sectional view of the TPA clip in a partially inserted position relative to the plug housing.
Figure 9:
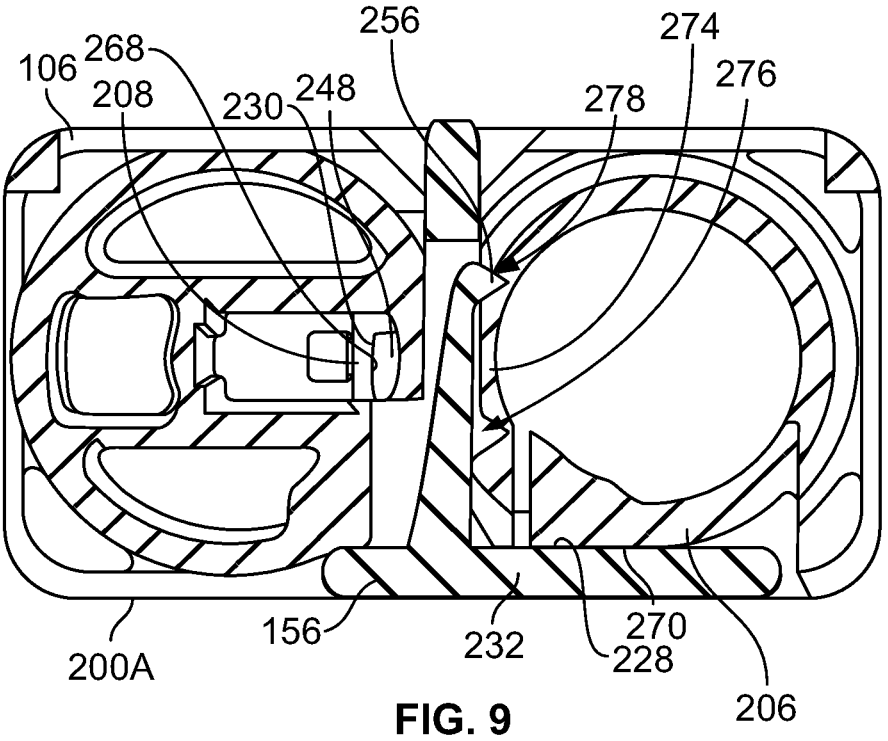
FIG. 9 shows a front cross-sectional view of the TPA clip in a fully inserted position relative to the plug housing.

FIGS. 8 and 9 show the assembly of the TPA clip 156 to the plug housing 106 according to an embodiment. FIG. 8 shows a front cross-sectional view of the TPA clip 156 in a partially inserted position relative to the plug housing 106. FIG. 9 shows a front cross-sectional view of the TPA clip 156 in a fully inserted position relative to the plug housing 106. The TPA clip 156 is configured to be loaded vertically into the recess 204 of the housing 106 in a loading direction 272 through the bottom side wall 200A. As the TPA clip 156 is inserted in the loading direction 272, the hook feature 256 of the coupling latch 250 engages a recess wall 274 that defines a portion of the recess 204. The recess wall 274 in an embodiment defines a lower detent 276 and an upper detent 278 that are spaced apart at different heights along the recess wall 274.

In the partially inserted position of the TPA clip 156 shown in FIG. 8, the hook feature 256 is received in the lower detent 276 to couple the TPA clip 156 to the plug housing 106. In the partially inserted position, the first blocking surface 228 of the TPA clip 156 does not back up the first deflectable latch 206, and the second blocking surface 230 does not back up the second deflectable latch 208. The TPA clip 156 may be positioned in the partially inserted position prior to loading the shielded and unshielded contact subassemblies 132, 134 (shown in FIG. 6) in the housing 106. With reference to FIG. 4, when the TPA clip 156 is in the partially inserted position, the position assurance tab 226 (shown in FIG. 3) protrudes below the shroud 114A in a loading path of the receptacle housing 108 (shown in FIG. 1) during a mating operation. The position assurance tab 226 is configured to stub against the receptacle housing 108 during the mating operation to prevent the plug hybrid connector 102 from mating to the receptacle hybrid connector 104 (FIG. 1), since the TPA clip 156 is not fully loaded in the housing 106.

Additional movement of the TPA clip 156 in the loading direction 272 causes the hook feature 256 to be received in the upper detent 278 when the TPA clip 156 reaches the fully inserted position shown in FIG. 9. In the fully inserted position, the bottom wall 232 of the TPA clip 156 may extend flush with the bottom side wall 200A of the housing 106. The blocking surface 228 along the bottom wall 232 abuts the exterior surface 270 of the first deflectable latch 206, and the blocking surface 230 along the ledge 248 abuts the exterior surface 268 of the second deflectable latch 208. In the fully inserted position, the position assurance tab 226 (shown in FIG. 3) in the cutout segment 224 (FIG. 4) aligns with the wall of the shroud 114A (FIG. 4) to allow the plug and receptacle hybrid connectors 102, 104 (FIG. 1) to mate to one another. Thus, the TPA clip 156 does not permit the connectors 102, 104 to be mated together until the TPA clip 156 is in the fully inserted position shown in FIG. 9.

Figure 10:
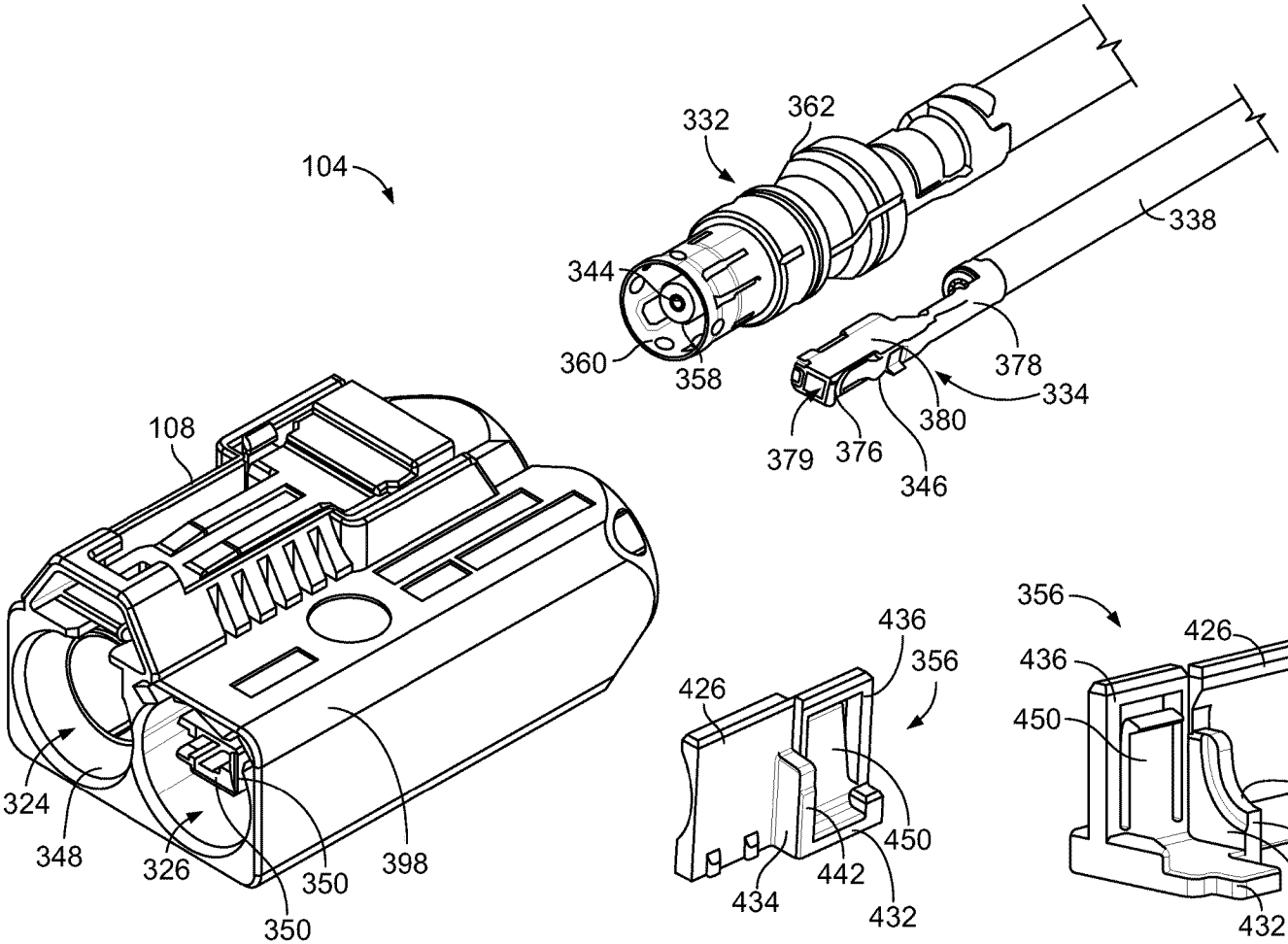
FIG. 10 is an exploded front perspective view of the receptacle hybrid electrical connector according to an embodiment.

FIG. 10 is an exploded front perspective view of the receptacle hybrid electrical connector 104 according to an embodiment. The receptacle connector 104 may have various features and components in common with the plug connector 102 shown and described in FIGS. 2-9. Therefore, components of the receptacle connector 104 that are similar to corresponding components of the plug connector 102 are not described in detail herein.

In an embodiment, the receptacle housing 108 of the receptacle connector 104 has a unitary, one-piece body 398. The housing 108 includes planar guide walls 350 within the unshielded cavity 326 that are integrally connected to the housing 108. The unshielded contact subassembly 334 includes a terminal 346 having a mating segment 376, a terminating segment 378, and a base segment 380 between the mating and terminating segments 376, 378. The terminating segment 378 is crimped to the cable 338. The base segment 380 is generally box-shaped. The mating segment 376 defines a socket 379 for receiving the pin-shaped mating segment 178 (shown in FIG. 3) of the terminal 146 (FIG. 3) of the plug connector 102 (FIG. 3) therein when the two connectors 102, 104 are mated. The mating segment 376 of the terminal 346 is held in place in the unshielded cavity 326 by the guide walls 350. When the connectors 102, 104 are mated, the guide walls 350 and the mating segment 376 of the terminal 346 are received in the channel 154 (shown in FIG. 2) defined by the guide walls 150 (FIG. 2) of the plug housing 106 (FIG. 2). The shielded contact subassembly 332 includes a center contact 344, a dielectric body 358 surrounding the center contact 344, an outer contact 360 surrounding the dielectric body 358, and a cavity insert 362 surrounding the outer contact 360. The center contact 344 includes a socket configured to receive the pin-shaped center contact 144 of the plug connector 102 therein.

Figure 11:
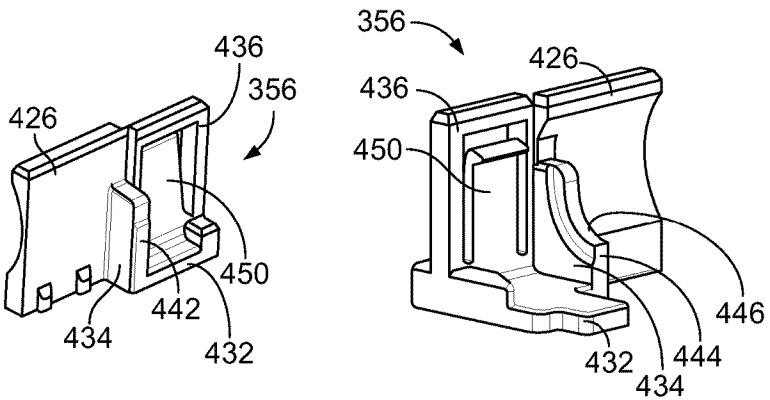
FIG. 11 is a rear perspective view of a TPA clip of the receptacle hybrid electrical connector according to an embodiment.

The receptacle connector 104 further includes a TPA clip 356 that is similar to the TPA clip 156 (shown in FIG. 3) of the plug connector 102. FIG. 11 is a rear perspective view of the TPA clip 356 according to an embodiment. Referring to both FIGS. 10 and 11, the TPA clip 356 includes a bottom wall 432, a front wall 434 extending from the bottom wall 432, a position assurance tab 426 extending from the front wall 434, a coupling latch 450, and an optional upright wall 436. The front wall 434 extends between a first perimeter side 442 and a second perimeter side 444. The TPA clip 356 defines a concave curved segment 446 along the second perimeter side 444.

In an embodiment, the position assurance tab 426 aligns with and defines a section of a curved interior wall 348 of the receptacle housing 108 that defines the shielded cavity 324. The first cylindrical shroud 114A (shown in FIG. 3) of the plug housing 106 (FIG. 3) that defines a portion of the shielded cavity 124 (FIG. 3) of the plug housing 106 is received within the shielded cavity 324 during the mating operation, and therefore may engage the position assurance tab 426. In an embodiment, if the TPA clip 356 is not fully inserted relative to the receptacle housing 108, a portion of the position assurance tab 426 protrudes into the cavity 324 in a loading path of the cylindrical shroud 114A to block the connectors 102, 104 from mating.

Figure 12:
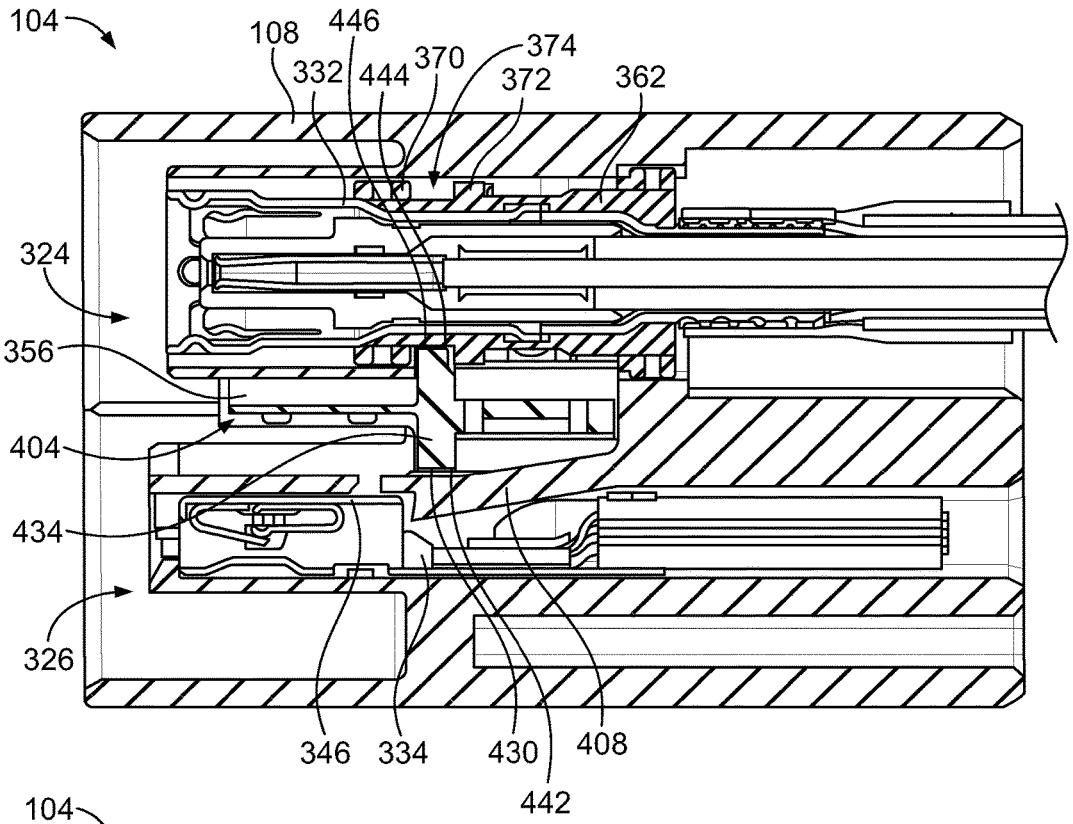
FIG. 12 is a top-down cross-sectional view of the receptacle hybrid electrical connector according to an embodiment.
Figure 13:
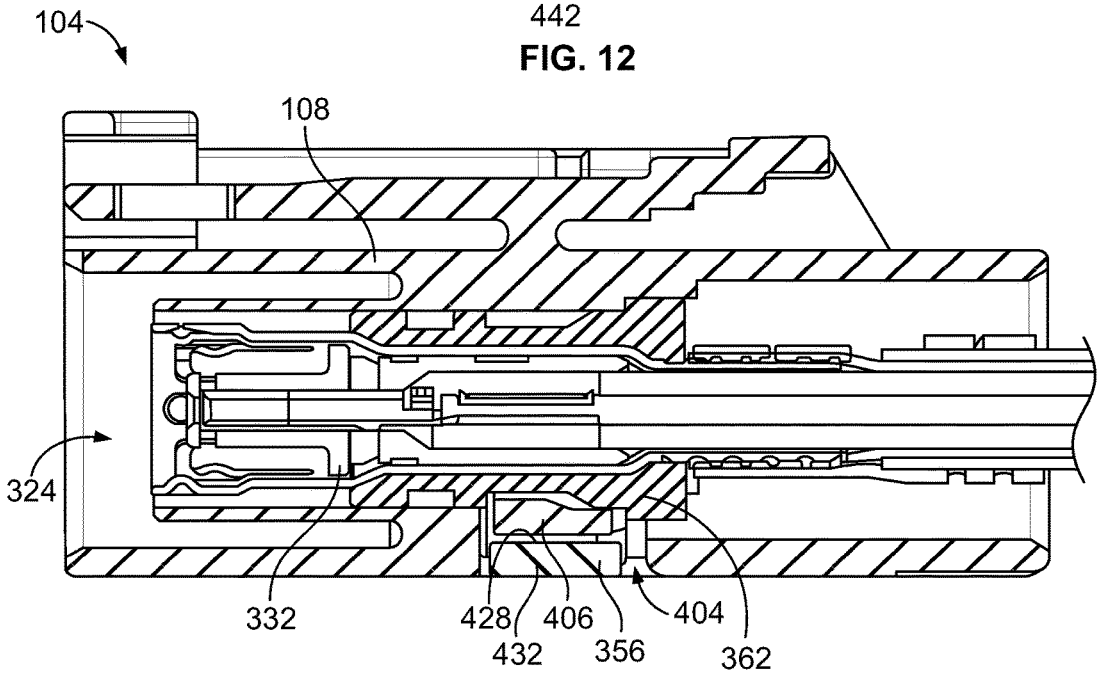
FIG. 13 is a side cross-sectional view of the receptacle hybrid electrical connector.

Additional reference is now made to FIGS. 12 and 13, in which FIG. 12 is a top-down cross-sectional view of the receptacle hybrid electrical connector 104 according to an embodiment, and FIG. 13 is a side cross-sectional view of the receptacle hybrid electrical connector 104. The TPA clip 356 is loaded into a recess 404 between the shielded and unshielded cavities 324, 326. As shown in FIG. 13, the receptacle housing 108 includes a first deflectable latch 406 that is integrally connected to the housing 108. The deflectable latch 406 is configured to extend into the shielded cavity 324 and engage the cavity insert 362 of the shielded contact subassembly 332 to hold the shielded contact subassembly 332 in the housing 108. The bottom wall 432 of the TPA clip 356 defines a first blocking surface 428 that is configured to block the deflectable latch 406 from deflecting away from the shielded contact subassembly 332. As shown in FIG. 12, the receptacle housing 108 also includes a second deflectable latch 408 integrally connected to the housing 108. The second deflectable latch 408 extends into the unshielded cavity 326 and engages the terminal 346 of the unshielded contact subassembly 334 to hold the unshielded contact subassembly 334 in the housing 108. The first perimeter side 442 of the front wall 434 of the TPA clip 356 defines a second blocking surface 430 that is configured to block the deflectable latch 408 from deflecting away from the unshielded contact subassembly 334. As further shown in FIG. 12, the concave curved segment 446 along the second perimeter side 444 of the front wall 434 is received in a groove 374 between first and second flanges 370, 372 of the cavity insert 362 to further support maintaining the axial position of the shielded contact subassembly 332 in the housing 108.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A hybrid electrical connector comprising:

a housing having a unitary, one-piece body that extends between a front end and an opposite rear end, the housing defining two adjacent cavities each extending between a respective mating opening at the front end and a respective cable opening at the rear end, the two cavities including a shielded cavity configured to hold a shielded contact subassembly therein and an unshielded cavity configured to hold an unshielded contact subassembly therein, the housing including a first deflectable latch extending into the shielded cavity and directly engaging the shielded contact subassembly therein to secure the shielded contact subassembly within the housing, the housing further including a second deflectable latch extending into the unshielded cavity and directly engaging the unshielded contact subassembly therein to secure the unshielded contact subassembly within the housing, the housing defining a recess through a side wall of the housing, the recess located generally between the shielded and unshielded cavities and a terminal position assurance (TPA) clip coupled to the housing and extending into the recess, the TPA clip including a first blocking surface and a second blocking surface, the first blocking surface configured to block the first deflectable latch of the housing from deflecting away from the shielded contact subassembly, the second blocking surface configured to block the second deflectable latch of the housing from deflecting away from the unshielded contact subassembly.

2. The hybrid electrical connector of claim 1, wherein the shielded and unshielded cavities have generally cylindrical shapes defined by curved interior walls, the housing including planar guide walls within the unshielded cavity, edges of the planar guide walls integrally connected to the curved interior walls that define the unshielded cavity.

3. The hybrid electrical connector of claim 1, wherein the housing includes a core structure and two adjacent cylindrical shrouds extending from a front wall of the core structure, the cylindrical shrouds aligning with and defining the mating openings of the corresponding shielded and unshielded cavities.

4. The hybrid electrical connector of claim 1, further comprising the shielded connector subassembly, the shielded connector subassembly including a center contact, a dielectric body surrounding the center contact, an outer contact surrounding the dielectric body, and a cavity insert surrounding the outer contact, the first deflectable latch engaging a shoulder of the cavity insert to secure the shielded contact subassembly in the housing.

5. The hybrid electrical connector of claim 1, further comprising the unshielded connector subassembly, the unshielded contact subassembly including a terminal having a mating segment, a terminating segment, and a base segment between the mating and terminating segments, the base segment being box-shaped and including a rear-facing wall that faces the terminating segment, the second deflectable latch engaging the rear-facing wall to secure the unshielded contact subassembly in the housing.

6. The hybrid electrical connector of claim 1, wherein the TPA clip has a front wall extending between a first perimeter side and a second perimeter side, the front wall having a concave curved segment along the first perimeter side, the concave curved segment extending into the shielded cavity and received in a groove of the shielded contact subassembly to secure the shielded contact subassembly in the housing, the second perimeter side extending into the unshielded cavity and engaging a side wall of the unshielded contact subassembly.

7. The hybrid electrical connector of claim 1, wherein the TPA clip has a position assurance tab extending from a front wall of the TPA clip, the position assurance tab extending into a loading path of a mating connector when the TPA clip is in a partially inserted position relative to the housing, the position assurance tab not extending into the loading path when the TPA clip is in a fully inserted position relative to the housing to allow the mating connector to mate to the hybrid electrical connector.

8. A hybrid electrical connector comprising:

a housing having a unitary, one-piece body that extends between a front end and an opposite rear end, the housing defining two adjacent cavities each extending between a respective mating opening at the front end and a respective cable opening at the rear end, the two cavities including a shielded cavity configured to hold a shielded contact subassembly therein and an unshielded cavity configured to hold an unshielded contact subassembly therein, the housing including a first deflectable latch extending into the shielded cavity and directly engaging the shielded contact subassembly therein to retain the shielded contact subassembly within the housing, the housing further including a second deflectable latch extending into the unshielded cavity and directly engaging the unshielded contact subassembly therein to secure the unshielded contact subassembly within the housing; and a terminal position assurance (TPA) clip coupled to the housing, the TPA clip extending through a recess through a side wall of the housing, the recess located generally between the shielded and unshielded cavities, the TPA clip having a bottom wall that defines a blocking surface, the blocking surface of the bottom wall configured to engage the first deflectable latch to block the first deflectable latch from deflecting away from the shielded contact subassembly.

9. The hybrid electrical connector of claim 8, wherein the housing includes a core structure and two adjacent cylindrical shrouds extending from a front wall of the core structure, the cylindrical shrouds aligning with and defining the mating openings of the corresponding shielded and unshielded cavities, the two cylindrical shrouds having approximately the same size.

10. The hybrid electrical connector of claim 8, wherein the TPA clip has a deflectable coupling latch, the deflectable coupling latch disposed between the shielded and unshielded cavities, the deflectable coupling latch having a hook feature engaging a complementary detent of the housing to couple the TPA clip to the housing, the detent of the housing located along a recess wall that defines a portion of the recess.

11. The hybrid electrical connector of claim 9, wherein the cylindrical shroud that aligns with the unshielded cavity includes planar guide walls within the cylindrical shroud, the planar guide walls having edges that are integrally connected to curved interior walls of the cylindrical shroud, the planar guide walls defining a channel within the cylindrical shroud.

12. The hybrid electrical connector of claim 8, wherein the TPA clip has a front wall extending between a first perimeter side and a second perimeter side, the front wall having a concave curved segment along the first perimeter side, the concave curved segment extending into the shielded cavity and received in a groove of the shielded contact subassembly to secure the shielded contact subassembly in the housing, the second perimeter side extending into the unshielded cavity and engaging a side wall of the unshielded contact subassembly.

13. The hybrid electrical connector of claim 8, wherein the TPA clip has an upright wall extending a length between a front end and a rear end, the upright wall having a ledge at least proximate to the rear end that projects into the unshielded cavity, the ledge defining a blocking surface configured to engage the second deflectable latch to block the second deflectable latch from deflecting away from the unshielded contact subassembly.

14. A hybrid electrical connector comprising:

a housing having a unitary, one-piece body that extends between a front end and an opposite rear end, the housing defining two adjacent cavities each extending between a respective mating opening at the front end and a respective cable opening at the rear end, the mating openings of the adjacent cavities defined by adjacent cylindrical shrouds that have curved interior walls, each of the cylindrical shrouds aligns with a different one of the two cavities, the two cavities including a shielded cavity configured to hold a shielded contact subassembly therein and an unshielded cavity configured to hold an unshielded contact subassembly therein, the housing including a first deflectable latch extending into the shielded cavity and a second deflectable latch extending into the unshielded cavity, wherein the first deflectable latch directly engages the shielded contact subassembly in the shielded cavity to secure the shielded contact subassembly within the housing, and the second deflectable latch directly engages the unshielded contact subassembly in the unshielded cavity to secure the unshielded contact subassembly within the housing, wherein the cylindrical shroud aligned with the unshielded cavity includes planar guide walls within the cylindrical shroud, the planar guide walls having edges that are integrally connected to the curved interior walls of the cylindrical shroud, the planar guide walls defining a channel within the cylindrical shroud.

15. The hybrid electrical connector of claim 14, wherein the cylindrical shroud aligned with the shielded cavity lacks planar guide walls therein.

16. The hybrid electrical connector of claim 14, wherein the housing defines a recess that extends through a side wall of the housing, the recess located generally between the shielded and unshielded cavities, and the hybrid electrical connector further comprises a terminal position assurance (TPA) clip coupled to the housing and extending into the recess, the TPA clip including a first blocking surface configured to engage and block the first deflectable latch from deflecting away from the shielded contact subassembly to support retention of the shielded contact subassembly within the shielded cavity.

17. The hybrid electrical connector of claim 16, wherein the TPA clip further includes a second blocking surface spaced apart from the first blocking surface, the second blocking surface configured to engage and block the second deflectable latch from deflecting away from the unshielded contact subassembly to support retention of the unshielded contact subassembly within the unshielded cavity.

18. The hybrid electrical connector of claim 14, wherein the housing defines a recess that extends through a side wall of the housing, the recess located generally between the shielded and unshielded cavities, and the hybrid electrical connector further comprises a terminal position assurance (TPA) clip coupled to the housing and extending into the recess, the TPA clip including a front wall extending between a first perimeter side and a second perimeter side, the first perimeter side having a concave curved segment that extends into the shielded cavity and is received in a groove of the shielded contact subassembly, the second perimeter side extending into the unshielded cavity and engaging a side wall of the unshielded contact subassembly.

19. The hybrid electrical connector of claim 14, wherein the housing defines a recess that extends through a side wall of the housing, the recess located generally between the shielded and unshielded cavities, and the hybrid electrical connector further comprises a terminal position assurance (TPA) clip coupled to the housing and extending into the recess, the TPA clip having a position assurance tab that extends into a loading path of a mating connector when the TPA clip is in a partially inserted position relative to the housing, the TPA clip configured such that the position assurance tab is spaced apart from the loading path when the TPA clip is in a fully inserted position relative to the housing.

20. The hybrid electrical connector of claim 14, wherein the housing defines a recess that extends through a side wall of the housing, the recess located generally between the shielded and unshielded cavities, the housing including a recess wall that defines a portion of the recess, the recess wall including a detent, wherein the hybrid electrical connector further comprises a terminal position assurance (TPA) clip coupled to the housing and extending into the recess, the TPA clip having a deflectable coupling latch with a hook feature, wherein the deflectable coupling latch extends through the recess and the hook feature engages the detent to couple the TPA clip to the housing.

* * * * *